US005519167A

United States Patent [19]

Kunimoto et al.

[11] Patent Number: 5,519,167

[45] Date of Patent: May 21, 1996

[54] MUSICAL TONE SYNTHESIZING APPARATUS

[75] Inventors: Toshifumi Kunimoto; Hideyuki Masuda; Toru Kitayama, all of Hamamatsu, Japan

[73] Assignee: Yamaha Corporation, Japan

[21] Appl. No.: 285,964

[22] Filed: Aug. 4, 1994

[30] Foreign Application Priority Data

Aug. 9, 1993 [JP] Japan ..... 5-197568
Oct. 13, 1993 [JP] Japan ..... 5-280073

[51] Int. Cl.[6] ..... G10H 1/12; G10H 5/00

[52] U.S. Cl. ..... 84/661; 84/659; 84/663

[58] Field of Search ..... 84/627, 631, 630, 84/663, 661, 625

[56] References Cited

U.S. PATENT DOCUMENTS 5,212,334 5/1993 Smith, III .
5,252,776 10/1993 Mutoh .

*Primary Examiner*—William M. Shoop, Jr.
*Assistant Examiner*—Jeffrey W. Donels
*Attorney, Agent, or Firm*—Graham & James

[57] ABSTRACT

In a musical tone synthesizing apparatus, employed by an electronic musical instrument, an excitation signal circulates through a waveguide to form a musical tone signal corresponding to a synthesized musical tone. The waveguide is configured by a loop circuit containing an adder, a delay circuit, a filter and an amplifier. A delay time used for the delay circuit is determined in response to a tone pitch of a musical tone to be produced, while a filter coefficient used for the filter is determined in response to a tone color of the musical tone to be produced. A multiplication coefficient used for the multiplier is generated in accordance with one of the tone pitch and delay time; or the multiplication coefficient is computed on the basis of the tone pitch and a decay rate which is set by a performer. In addition, a different multiplication coefficient can be generated in response to a state of an envelope waveform of the musical tone to be produced. For example, the multiplication coefficient to be generated for an attack portion of the envelope waveform can be differed from the multiplication coefficient to be generated for a decay portion of the envelope waveform. By finely controlling a loop gain of the waveguide corresponding to the multiplication coefficient, a fine control can be performed for the synthesis of the musical tones.

6 Claims, 10 Drawing Sheets

MUSICAL TONE SYNTHESIZING APPARATUS

BACKGROUND OF THE INVENTION

1. Field of the Invention

The present invention relates to a musical tone synthesizing apparatus which synthesizes musical tones by simulating sounds of acoustic musical instruments.

2. Prior Art

The musical tone synthesizing apparatuses conventionally known are designed to synthesize musical tones by using simulation models which simulate sounding mechanisms of the acoustic musical instruments. Among those musical tone synthesizing apparatuses, some of them are designed to simulate sounds of wind instruments. This kind of musical tone synthesizing apparatus simulating the sounding mechanism of the wind instrument is mainly configured by an excitation circuit and a resonance circuit, which are connected together. Herein, the excitation circuit is provided to simulate operations of a mouthpiece portion, while the resonance circuit is provided to simulate resonance characteristics of a resonance tube.

Some wind instruments such as the saxophone, trumpet and clarinet have a resonance tube which has a cone-like shape. This resonance tube can be simulated by a simulation model of tube constructed by a plurality of cylindrical tubes, each having a different diameter, which are assembled together. Each of those cylindrical tubes can be electronically simulated by a pair of a waveguide and a junction. Herein, the waveguide, at least containing a delay circuit, is a bi-directional transmission circuit, while the junction is a connection circuit. When simulating the operations of the above-mentioned tube, there are provided plural pairs of waveguide and junction, which are connected together in a cascade-connection manner. The musical tone synthesizing apparatus using the waveguide and junction is disclosed in Japanese Patent Laid-Open Publication No. 63-40199, for example.

In order to simulate the propagation loss of the air waves which are reflected at the terminal portion of the resonance tube, the waveguide utilizes a multiplier and a low-pass filter as well as the delay circuit. A manner of the reflection of the air waves depends upon the tone color, so that a 'reflection coefficient' is introduced to represent the manner of reflection to be selected. As the reflection coefficient, the multiplication coefficient and cut-off frequency are supplied to the multiplier and low-pass filter respectively.

An envelope waveform of the musical tone to be synthesized by the musical tone synthesizing apparatus can be changed by changing an absolute value of a reflection coefficient $\gamma$. In order to obtain the envelope waveform as shown in FIG. 11A, the absolute value of the reflection coefficient $\gamma$ is set at '1'. In FIG. 11A, the envelope waveform is rapidly rising (in other words, the envelope waveform has a sharp attack portion) after performance-input data (i.e., performance information, used for the production of the musical tone, which represents the breath pressure applied to the mouthpiece of the wind instrument, for example) is supplied to the musical tone synthesizing apparatus; and then, the envelope waveform is gradually decaying (in other words, the envelope waveform has a dull decay portion) after the supply of the performance-input data is stopped. In order to obtain an envelope waveform as shown in FIG. 11B, the absolute value of the reflection coefficient $\gamma$ is reduced. In FIG. 11B, the envelope waveform is gradually rising after the performance-input data is supplied to the musical tone synthesizing apparatus; and then, the envelope waveform is rapidly decaying after the supply of the performance-input data is stopped.

Recently, some demands are raised such that certain musical tones, which cannot be obtained by the existing acoustic musical instruments, are synthesized. However, the musical tone synthesizing apparatuses conventionally known cannot satisfy the above-mentioned demands because the reflection coefficient should be constant during the supply of the performance-input data. In other words, a changing manner of the envelope waveform depends upon the reflection coefficient, so that while the reflection coefficient is remained constant, the envelope waveform cannot be arbitrarily changed. In short, there is a problem that the conventional musical tone synthesizing apparatus cannot synthesize the musical tone having the envelope waveform, to be arbitrarily changed, in which both of the attack portion and decay portion are intentionally made sharp or dull, for example.

Meanwhile, another type of musical tone synthesizing apparatus conventionally known has an automatic key-scaling function by which a key-scaling operation is automatically performed for the delay-feedback-type sound source. This delay-feedback-type sound source is disclosed in Japanese Patent Laid-Open Publication No. 58-48109, for example. An example of this sound source is shown in FIG. 12.

In FIG. 12, an excitation-waveform generating portion 101 stores fundamental musical-tone waveforms so as to selectively output one musical-tone waveform. This excitation-waveform generating portion 101 receives signals "WAVE", "TOUCH" and "KON". The signal WAVE is used to designate the musical-tone waveform to be selectively read out from among the musical-tone waveforms stored in the excitation-waveform generating portion 101; the signal TOUCH represents an intensity of depressing the key of the keyboard; and the signal KON designates a timing to output the read musical-tone waveform. Thus, an initial musical-tone waveform is outputted from the excitation-waveform generating portion 101 and is supplied to an adder 102. The adder 102 adds the initial musical-tone waveform to an output signal of a variable amplifier 103. Then, a result of the addition performed by the adder 102 is supplied to a filter 104. The filter 104 receives a signal FC which is used to control a filter coefficient. Thus, on the basis of the filter coefficient controlled by the signal FC, the filter 104 effects a certain filtering operation on the result of addition produced by the adder 102. Through the filtering operation, a desired frequency characteristic is imparted to the musical tone. An output signal of the filter 104 is outputted as a musical tone signal and is also fed back to the adder 102 through a feedback loop consisting of the variable amplifier 103 and a variable delay circuit 105.

The variable amplifier 103 is provided to determine a loop gain. In other words, this variable amplifier 103 is provided to attenuate a level of a signal to be fed back to the adder 102. A gain 'a' of the variable amplifier 103 is controlled responsive to a gain signal. This gain 'a' is affected by the characteristic of the filter 104, whereas if the gain 'a' is set at '1' (i.e., 0 dB) at the band-pass range of the filter 104, the gain 'a' should be smaller than '1' while an decaying sound is producing. The variable amplifier 103 multiples an output signal of the variable delay circuit 105 by the gain 'a' to produce a feedback signal which is then supplied to the adder 102. The variable delay circuit 105 has a delay time DLY which is controlled responsive to a delay-amount signal supplied thereto, so that the output signal of the filter 104 is delayed by the delay time DLY. The pitch of the musical tone is determined by the delay time of the variable delay circuit 105. Strictly speaking, the pitch of the musical tone is determined by the delay time of the variable delay circuit 105 as well as the delay time which is caused by the filtering operation performed by the filter 104.

When producing the musical tone having a higher pitch, it is necessary to reduce the amount of delay to be applied to the musical tone signal. On the other hand, when producing the musical tone having a lower pitch, it is necessary to increase the amount of delay to be applied to the musical tone signal. As compared to the lower-pitch musical tone, the production of the higher-pitch musical tone requires a more number of times by which the initial musical-tone waveform is repeatedly passing through the feedback loop. This means that as compared to the lower-pitch musical tone, the production of the higher-pitch musical tone requires a more number of times by which the musical tone signal is repeatedly multiplied by the gain 'a' by the variable amplifier 103. If the gain is constant, as compared to the lower-pitch musical tone, the higher-pitch musical tone has a shorter period of time in which the production of the musical tone is sustained.

For example, when producing the musical tone at 440 Hz, the multiplication using the gain is repeatedly performed by four-hundred-and-forty times in one second. Similarly, when producing the musical tone at 880 Hz, the multiplication is performed by eight-hundred-and-eighty times in one second. Thus, when producing those musical tones by using the same initial musical-tone waveform and the same gain, an decay rate for the musical tone of 880 Hz is the double of an decay rate for the musical tone at 440 Hz. In other words, every time the pitch is raised up by one octave, the decay rate is doubled.

In order to solve the problem caused by the variation of the decay rate, some methods are employed. According to a first method, a break point (i.e., a split point between the registers) is set such that the sustaining time to continuously produce the musical tone is not extremely changed with respect to each of the musical tones to be produced. This method controls the sustaining time of each musical tone to be almost constant, within the whole register, in terms of the listening comprehension. A second method uses a data table by which the value of the gain is changed by each musical tone to be produced so that the sustaining time will be constant.

In the first method described above, however, it is necessary to change a timing to set the break point with respect to each musical tone. Therefore, this method requires a complex processing. Even in the second method, the values of the gain should be stored in the data table with respect to each musical tone. Thus, a storage capacity to be required in the second method should be increased, which will result in an increase of the cost for manufacturing the apparatus. Further, the conventional apparatus as shown in FIG. 12 is configured such that a predetermined value is set for the gain in response to the musical tone to be designated. Thus, the conventional apparatus is disadvantageous in that a performer cannot freely set the sustaining time of the musical tone.

SUMMARY OF THE INVENTION

It is accordingly a primary object of the present invention to provide a musical tone synthesizing apparatus which is capable of synthesizing the musical tones, well simulating the sounds of the wind instruments, whose envelope waveforms can be arbitrarily changed.

It is another object of the present invention to provide a musical tone synthesizing apparatus which is capable of freely changing the sustaining time of the musical tone to be produced.

According to the present invention, a musical tone synthesizing apparatus contains at least one waveguide through which an excitation signal circulates to form a musical tone signal representing a synthesized musical tone. The waveguide is configured by a loop circuit containing an adder, a delay circuit, a filter and an amplifier. A delay time used for the delay circuit is determined in response to a tone pitch of a musical tone to be produced, while a filter coefficient used for the filter is determined in response to a tone color of the musical tone to be produced. A multiplication coefficient used for the multiplier is generated in accordance with the tone pitch and delay time; or the multiplication coefficient is computed on the basis of the tone pitch and a decay rate which is set by a performer.

In the above-mentioned musical tone synthesizing apparatus, a different multiplication coefficient can be generated in response to a state of an envelope waveform of the musical tone to be produced. For example, the multiplication coefficient to be generated for an attack portion of the envelope waveform can be differed from the multiplication coefficient to be generated for a decay portion of the envelope waveform. By finely controlling the loop gain of the waveguide corresponding to the multiplication coefficient, a fine control can be performed for the synthesis of the musical tones.

BRIEF DESCRIPTION OF THE DRAWINGS

Further objects and advantages of the present invention will be apparent from the following description, reference being had to the accompanying drawings wherein the preferred embodiment of the present invention is clearly shown.

In the drawings.

DESCRIPTION OF THE PREFERRED EMBODIMENTS

[A]First Embodiment

Before specifically describing a musical tone synthesizing apparatus according to a first embodiment of the present invention, a fundamental configuration of the first embodiment will be described.

Figure 1:
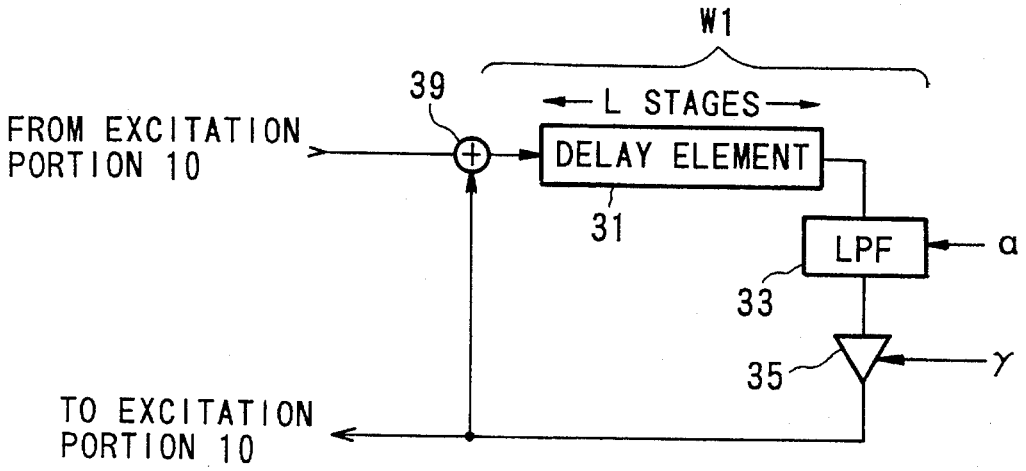
FIG. 1 is a block diagram showing a fundamental configuration of a musical-tone generating portion using a waveguide.

FIG. 1 shows a waveguide W1 coupled with an excitation portion 10 (not shown). The excitation portion 10 is provided to simulate the mouthpiece portion of the wind instrument, so that the excitation portion 10 produces the performance-input data such as a breath-pressure signal which is created in a duration between start and end timings of the musical tone to be produced.

The waveguide W1 simulates an acoustic impedance of the cylindrical tube such as the resonance tube of the clarinet. The waveguide W1 is configured by a loop circuit containing a delay element 31, a low-pass filter 83, a multiplier 35 and an adder 39. The delay element 81 simulates the delay which is occurred when the sound wave reciprocates through the cylindrical tube; the low-pass filter 33, receiving a filter coefficient $\alpha$ (representing a cut-off frequency), simulates an acoustic loss in the cylindrical tube; and the multiplier 85, receiving a multiplication coefficient $\gamma$, simulates the reflection of the sound wave at the terminal portion of the cylindrical tube. An excitation signal produced by the excitation portion 10 is applied to the adder 39, while an output signal of the multiplier 35 is delivered to the excitation portion 10 and the adder 39. The delay element 31 is configured by a plurality of shift registers, the number of which is set at 'L' (where 'L' is an integral number). Those shift registers act responsive to a sampling frequency Fs. The number 'L' of the shift registers (in other words, the number 'L' of the delay stages included in the delay element 31) is changed in accordance with the pitch of the musical tone to be produced. Because, in the wind instrument, the pitch of the musical tone to be produced depends upon the length of the tube corresponding to the resonance frequency.

Next, the contents of the multiplication coefficient $\gamma$ will be described in detail.

In a time 'dt' in which the amplitude of the breath-pressure signal is set at 20 dB (=1/10), the breath-pressure signal is progressed by 'Fs·dt' sampling periods. In other words, this signal circulates through the loop circuit by certain times, the number of which is expressed by a following formula (1).

$$Fs \cdot dt/L \tag{1}$$

Herein, every time the signal circulates through the loop circuit once, the amplitude of the signal is multiplied by '$\gamma$'. The gain to be applied to the signal is equal to 20 dB after the signal repeatedly circulates through the loop circuit by several times, the number of which is represented by the formula (1). This can be expressed by a following equation (2).

$$|\gamma|^{Fs \cdot dt/L}=10^{-1} \tag{2}$$

Now, the terminal portion of the cylindrical tube to be simulated is a closed end, whereas the multiplication coefficient $\gamma$ has a negative value, so that the equation (2) can be expanded into an equation (3).

$$\gamma=-10^{-L/Fs \cdot dt} \tag{3}$$

In the simulation of the conical tube, having a cone-like shape, like the resonance tube of the saxophone. The conical tube can be assumed to be equivalent to a combination of two kinds of tubes. Thus, the electronic circuit simulating the conical tube is configured as shown in FIG. 2, wherein a waveguide W2, simulating the conical tube, is connected in the cascade-connection manner with the foregoing waveguide W1.

Figure 2:
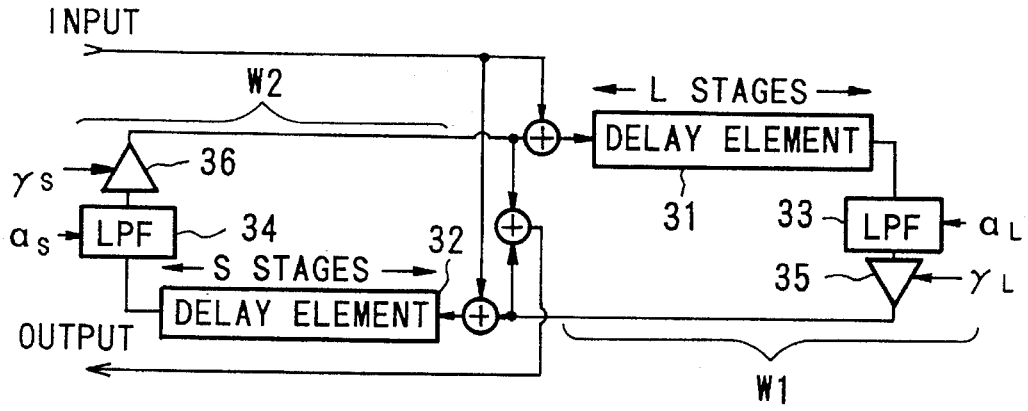
FIG. 2 is a block diagram showing another example of the musical-tone generating portion using two waveguides.
Figure 3:
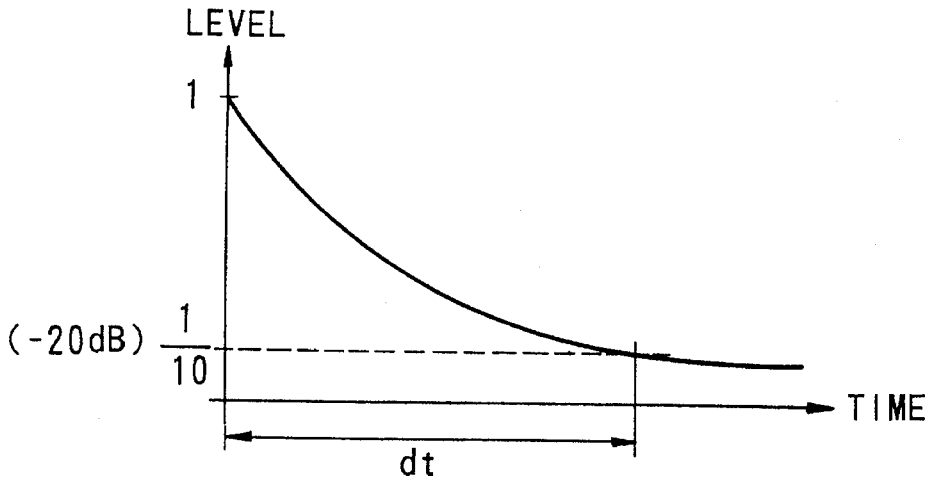
FIG. 3 is a graph showing a changing manner of the reflection coefficient with respect to time.

A total number of delay stages included in the electronic circuit shown in FIG. 2 is a sum of the numbers of delay stages included in the waveguide W1 and W2. Every time the signal circulates through a loop circuit, configured by the waveguides W1 and W2, once, the signal is multiplied by "$\gamma_S \cdot \gamma_L$". Therefore, as similar to the aforementioned equation (3), an equation (4) can be established.

$$|\gamma_S| \cdot |\gamma_L|=10^{-(L+S)/(Fs \cdot dt)} \tag{4}$$

In the above equation (4), if a relationship of "$\gamma_S=\gamma_L$" is existed, the equation (4) can be rewritten by an equation (5).

$$\gamma_S^2=\gamma_L^2=10^{-(L+S)/(Fs \cdot dt)} \tag{5}$$

Thus, the multiplication coefficients $\gamma_S$ and $\gamma_L$ can be expressed by an equation (6).

$$\gamma_S=\gamma_L=10^{-(L+S)/(2Fs \cdot dt)} \tag{6}$$

Now, when the time dt is constant, the number of delay stages can be determined with respect to the pitch of the musical tone to be produced; and then, the number of delay stages is put into the aforementioned equation (3) (which corresponds to the electronic circuit shown in FIG. 1), so that the multiplication coefficient $\gamma$ representing the reflection coefficient can be determined. By determining the reflection coefficient, the decay rate, which is applied to the musical tone after the supply of the performance-input data is stopped, can be set constant with respect to each pitch.

Next, a musical tone synthesizing apparatus according to the first embodiment employing the above-mentioned fundamental configuration will be described.

Figure 4:
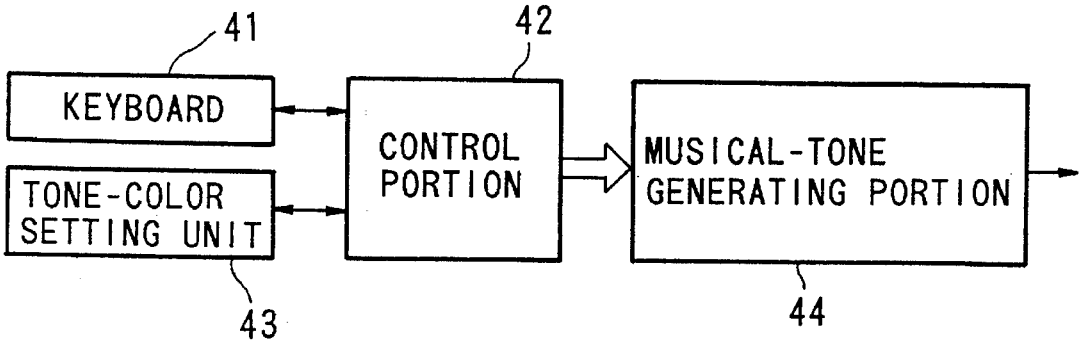
FIG. 4 is a block diagram showing a musical tone synthesizing apparatus according to a first embodiment of the present invention.

FIG. 4 is a block diagram showing an electronic musical instrument. In FIG. 4, a numeral 41 denotes a keyboard consisting of plural keys. This keyboard 41 produces several kinds of signals such as a key-on signal 'KON', a pitch signal 'PITCH' and touch information. Herein, the key-on signal KON indicates a key-on event; the pitch signal PITCH represents a tone pitch of the key depressed; and the touch information represents an intensity of touching the key. Those are supplied to a control portion 42.

A tone-color setting unit 43 is provided to select the tone color for the musical tones to be produced and to set parameters which define the envelope waveform. Then, several kinds of information created by the tone-color setting unit 43 are supplied to the control portion 42.

On the basis of the information given from the keyboard 41 and the tone-color setting unit 43, the control portion 42 creates several kinds of parameters, which are then supplied to a musical-tone generating portion 44.

Next, the details of the musical-tone generating portion 44 will be described by referring to FIG. 5.

Figure 5:
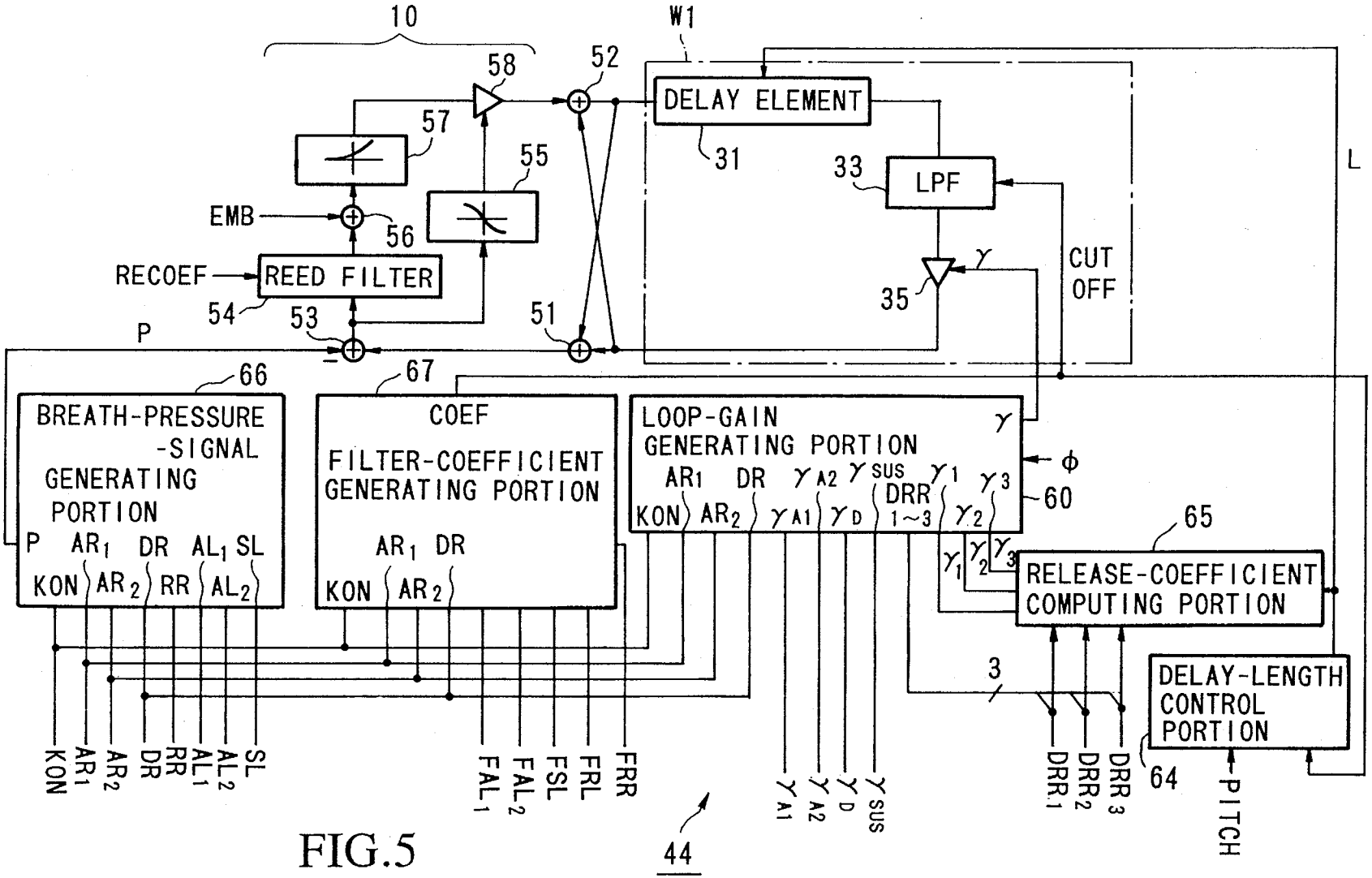
FIG. 5 is a block diagram showing a musical-tone generating portion provided in the musical tone synthesizing apparatus shown in FIG. 4.

As shown in FIG. 5, the musical-tone generating portion 44 is configured by the excitation portion 10, the waveguide W1 (as shown in FIG. 1) and other portions. The other portions are provided to supply the parameters, supplied from the control portion 42, to the excitation portion 10 and the waveguide W1 at good timings which are determined responsive to a lapse of time to be passed after the key-on event or key-off event. An output signal of the musical-tone generating portion 44 is supplied to another processing device (not shown) externally provided. If the output signal is supplied to a sound system, configured by an amplifier and speakers, the musical tones are produced by the sound system.

An output signal of the waveguide W1 is supplied to a first input terminal of an adder 51 as well as a first input terminal of an adder 52. An output signal of the adder 51 corresponds to pressure of air-vibration waves which are fed back to the reed within the mouthpiece of the wind instrument. This output signal is supplied to an adder 53. The adder 53 subtracts a breath-pressure signal P, corresponding to the breath-blowing pressure applied to the mouthpiece, from the output signal of the adder 51 to form a signal which corresponds to the inner pressure of the mouthpiece.

The output signal of the adder 53 is delivered to a reed filter 54 and a non-linear circuit 55. Herein, the reed filter 54 simulates a response characteristic of the reed against the variation of the pressure inside the mouthpiece, while the non-linear circuit 55 simulates a saturation characteristic of the air-flow velocity inside the mouthpiece against the air pressure inside the mouthpiece. The reed filter 54 receives a coefficient 'RECOEF', representing the cut-off frequency, selectivity or the like, which is controlled responsive to the tone color currently set. Next, an adder 56 adds an output signal of the reed filter 54 to a signal EMB corresponding to the pressure which the performer applies to the mouthpiece. Thus, an output signal of the adder 56 corresponds to the pressure applied to the reed. This output signal is supplied to a non-linear circuit 57. The non-linear circuit 57 simulates a variation of the sectional area of the gap between the reed and mouthpiece against the variation of the pressure applied to the reed. Output signals of the non-linear circuits 55 and 57 are multiplied by a multiplier 58 to form a signal corresponding to a variation in volume of the air flow passing through the gap between the reed and mouthpiece. This signal is supplied to a second input terminal of the adder 52. Thus, the adder 52 adds this signal to the output signal of the waveguide W1; and then, an output signal of the adder 52 is delivered to a second input terminal of the adder 51 and the waveguide W1. Hence, the output signal of the adder 52 circulates through the loop circuit of the waveguide W1.

A loop-gain generating portion 60 is provided to produce the reflection coefficient $\gamma$ based on the parameters currently set. The reflection coefficient is supplied to the multiplier 35, provided within the waveguide W1, in accordance with the key-on signal KON.

Figure 6:
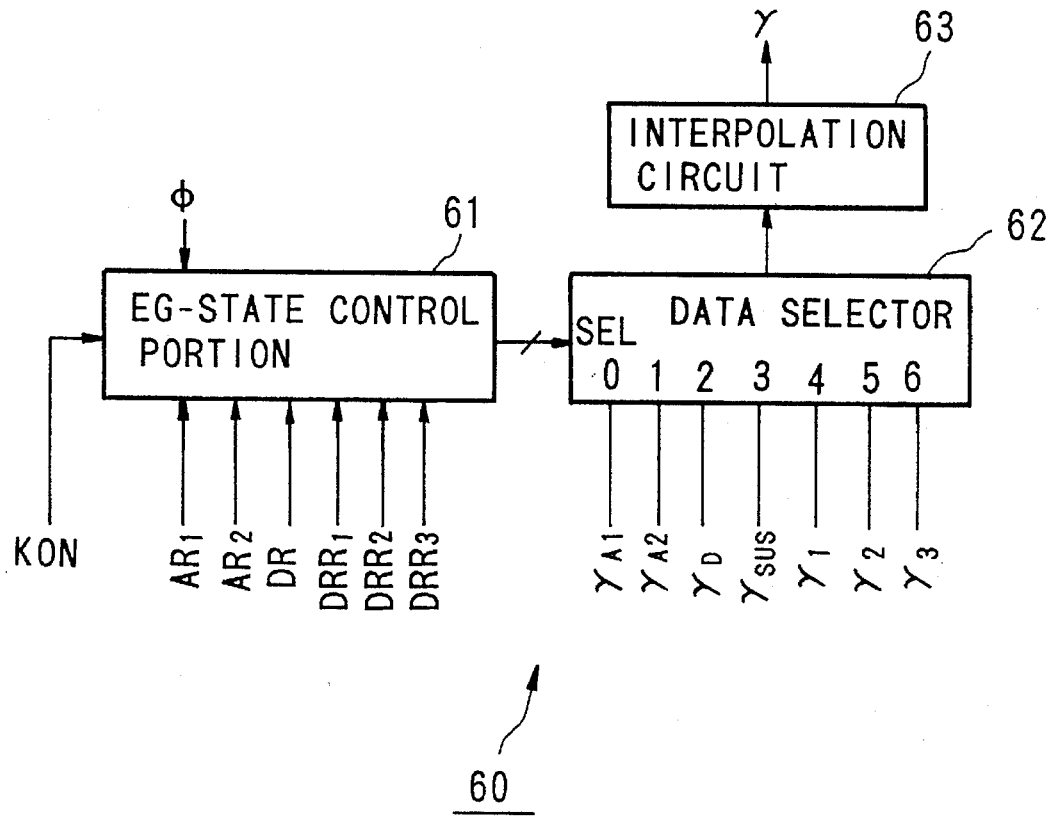
FIG. 6 is a block diagram showing a detailed configuration of a loop-gain generating portion shown in FIG. 5.

FIG. 6 is a block diagram showing an example of the electronic configuration of the loop-gain generating portion 60. In FIG. 6, an EG-stage control portion 61 (where a term 'EG' represents the envelope generator) counts sampling clocks $\phi$ when the key-on signal KON is supplied thereto. Before a result of the counting indicates a certain parameter (e.g., AR1-DRR3 supplied to the EG-state control portion 61) which defines a direction of time regarding the envelope waveform, the EG-state control portion 61 changes its output signal. A data selector 62 receives the output signal of the EG-state control portion 61 at a control-input terminal 'SEL'. The data selector 62 also receives seven data so as to select one of them in accordance with the signal inputted to the control-input terminal SEL. The selected data is used as the reflection coefficient $\gamma$ (i.e., the multiplication coefficient supplied to the multiplier 35), which simulates the reflection of the sound wave at the terminal portion of the resonance tube.

The data selected by the data selector 62 can be directly used as the reflection coefficient $\gamma$. However, it is possible to employ an interpolation circuit 63, as shown in FIG. 6, by which the output data of the data selector 62 is subjected to interpolation so as to produce the reflection coefficient $\gamma$. As the interpolation circuit 63, the low-pass filter can be employed.

In FIG. 5, a delay-length control portion 64 controls a delay length (i.e., number of delay stages) 'L' of the delay element 31 on the basis of the pitch signal PITCH and a filter coefficient (i.e., cut-off frequency) CUTOFF of the low-pass filter 33. The reason why the number of delay stages 'L' is determined based on the filter coefficient CUTOFF as well as the pitch signal PITCH is that if the cut-off frequency of the low-pass filter 33 is changed, the amount of delay of the low-pass filter 33 should be changed, so that the whole amount of delay in the loop circuit of the waveguide W1 should be changed. By considering the filter coefficient CUTOFF of the low-pass filter 33 when determining the number of delay stages 'L', it is possible to control the whole amount of delay of the waveguide W1 in response to the pitch signal PITCH.

The delay-length control portion 64 is configured by a data table which memorizes the numbers of delay stages in connection with the pitch signal and filter coefficients. Thus, in response to the pitch signal PITCH and the filter coefficient CUTOFF currently given, the corresponding number of delay stages 'L' is read from the data table.

A release-coefficient supply portion 65 computes a coefficient 7 i on the basis of a damping release rate DRRi (where i=1, 2 or 3) and the number of delay stages 'L'. Herein, as described before, the number of delay stages 'L' is controlled by the delay-length control portion 64, while the damping release rate DRRi defines a duration, just after the key-off event, in which the reflection coefficient is supplying. Herein, the release-coefficient supply portion 65 uses an equation (7) to compute the coefficient $\gamma_i$. The equation (7) is obtained from the foregoing equation (3) in which 'dt' is replaced by 'DRRi'.

$$\gamma_i = -10^{-L/(Fs \cdot DRRi)} \tag{7}$$

A breath-pressure-signal generating portion 66 generates a breath-pressure signal P in accordance with the key-on signal KON. This breath-pressure-signal generating portion 66 receives several kinds of parameters which define the breath-pressure signal P.

A filter-coefficient generating portion 67 generates the filter coefficient CUTOFF for the low-pass filter 33 in response to the key-on signal KON.

As shown in FIG. 5, several kinds of parameters are supplied to each of the breath-pressure signal generating portion 66, the loop-gain generating portion 60 and the filter-coefficient generating portion 67. FIGS. 7A to 7E are graphs which show relationships between the parameters and the envelope waveforms defined by those parameters. The waveforms shown in FIGS. 7A to 7E are altered in response to the key-on event KON (see FIG. 7D) indicating the start timing to generate the musical tone. In the envelope waveform, the attack portion is formed responsive to the key-on event, while the release portion is formed responsive to the key-off event.

Figures 7A, 7B, 7C, 7D, 7E:
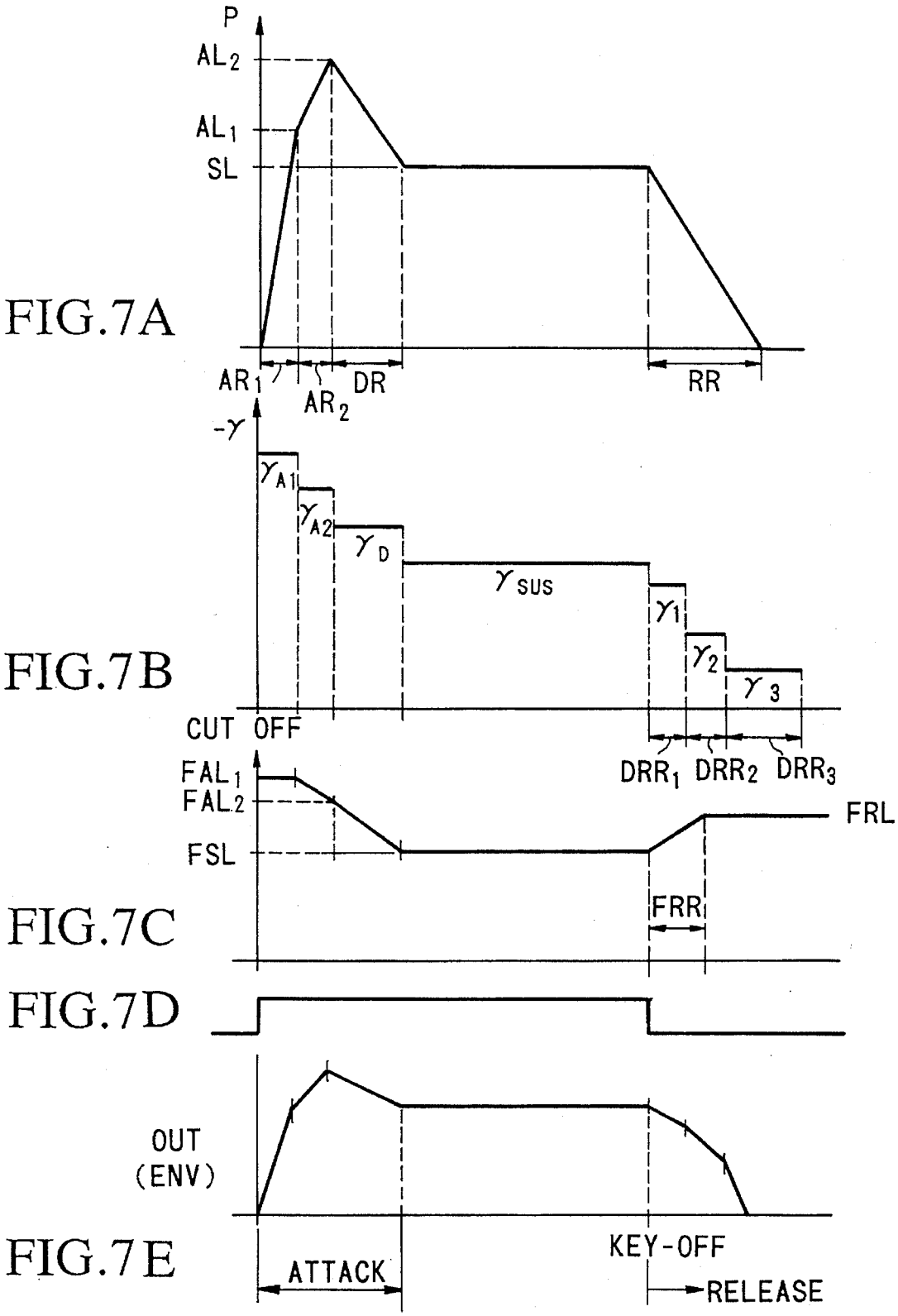
FIGS. 7A to 7E are graphs showing waveforms of signals and coefficients used in the circuitry shown in FIG. 5.

FIG. 7A shows a waveform of the breath-pressure signal P generated by the breath-pressure signal generating portion 66. A rising portion (i.e., attack portion) of the waveform is divided into three intervals of time respectively defined by attack rates AR1, AR2 and a decay rate DR. Their target amplitude levels are respectively defined by attack levels AL1, AL2 and a sustain level SL. A falling portion (i.e., release portion) of the waveform corresponds to an interval of time defined by a release rate RR. Between the attack portion and release portion, a sustain portion, in which the amplitude is remaining at the sustain level SL, is formed.

The above-mentioned parameters AR1, AR2, DR, RR, AL1, AL2 and SL, which define the waveform shown in FIG. 7A and are supplied to the breath-pressure signal generating portion 66, can be arbitrarily changed by operating the tone-color setting unit 43.

FIG. 7B shows a level-changing manner of the reflection coefficient outputted from the loop-gain generating portion 60. The reflection coefficient is changed in level, as shown in FIG. 7B, in each of the intervals of time of the breath-pressure signal P shown in FIG. 7A. In the aforementioned attack portion which starts after the key-on event, a reflection coefficient $\gamma_{A1}$ is selected at the interval of time defined by the attack rate AR1; a reflection coefficient $\gamma_{A2}$ is selected at the interval of time defined by the attack rate AR2; and a reflection coefficient $\gamma_D$ is selected at the interval of time defined by the decay rate DR. In the sustain portion, a reflection coefficient $\gamma_{SUS}$ is selected. In the release portion which starts after the key-off event, a reflection coefficient $\gamma_1$ is selected at the interval of time defined by the damping release rate DRR1; a reflection coefficient $\gamma_2$ is selected at the interval of time defined by the damping release rate DRR2; and a reflection coefficient $\gamma_3$ is selected at the interval of time defined by the damping release rate DRR3. The reflection coefficients $\gamma_1$ to $\gamma_3$ are determined by the aforementioned equation (7).

FIG. 7C shows a manner of changing the filter coefficient CUTOFF by the filter-coefficient generating portion 67. The filter coefficient to be outputted from the filter-coefficient generating portion 67 is changed responsive to the waveform of the breath-pressure signal P. The attack portion of the waveform shown in FIG. 7C is divided into three intervals of time respectively defined by the attack rates AR1. AR2 and the decay rate DR. Target amplitude levels in those intervals of time are respectively defined by filter-attack levels FAL1, FAL2 and a filter-sustain level FSL. An interval of time, in the release portion of the waveform shown in FIG. 7C, is defined by a filter-release rate FRR, while a target amplitude level thereof is defined by a filter-release level FRL. After the level of the waveform reaches the filter-release level FRL, this level is remained for a while. The filter-sustain level FSL defines the constant level which is maintained in the sustain portion formed between the attack portion and release portion.

Before performing the key-depressing operations, the tone-color setting unit 43 is operated to select the tone color and the parameters which define the waveforms as described above. The data representing the selected tone color and the selected parameters are supplied to the control portion 42.

Thereafter, when a key of the keyboard 41 is depressed, the key-on signal KON is set at a high level, while the aforementioned pitch signal PITCH and touch information are produced responsive to the key depressed. Thus, they are supplied to the control portion 42.

The control portion 42 supplies the key-on signal KON, the pitch signal PITCH and the parameters to the musical-tone generating portion 44. However, some parameters, which relate to a direction of amplitude (or direction of level) among the foregoing parameters defining the waveform of the breath-pressure signal P (see FIG. 7A), are somewhat corrected under the consideration of the touch information, so that the corrected parameters are supplied to the musical-tone generating portion 44, whereas the other parameters are directly supplied to the musical-tone generating portion 44.

Just after the key-on event, the musical-tone generating portion 44 starts to generate the breath-pressure signal P having the waveform as shown in FIG. 7A, in which the attack portion is divided into the three intervals of time respectively defined by the attack rates AR1. AR2 and the decay rate DR. The breath-pressure signal P is supplied to the excitation portion 10 wherein it is processed into a signal which corresponds to the volume variation of the air flow passing through the gap between the reed and mouthpiece. Then, the signal is introduced into and circulates through the waveguide W1. Thereafter, an output signal of the waveguide W1 is fed back to the excitation portion 10.

In the waveguide W1, the reflection coefficient $\gamma$, simulating the manner of reflection of the sound wave, is supplied to the multiplier 35 as its multiplication coefficient. This multiplication coefficient "$\gamma$" is changed by the loop-gain generating portion 60 at each of the intervals of time respectively defined by the attack rates AR1, AR2 and the decay rate DR as shown in FIG. 7A. On the other hand, the filter coefficient CUTOFF supplied to the low-pass filter 33 is changed by the filter-coefficient generating portion 67 as shown in FIG. 7B.

Thus, an attack portion as shown in FIG. 7E is formed for the envelope waveform of the musical tone to be generated by the musical-tone generating portion 44. By intentionally increasing the reflection coefficient 7 to be larger than '1', it is possible to make the inclination of the attack portion sharper.

Thereafter, when the depressed key is released so that a key-off event occurs, the key-on signal KON is set at a low level.

Before the key-off event occurs, the level of the breath-pressure signal P is maintained at the sustain level SL which is the constant level. In the duration, defined by the release rate RR, after the occurrence of the key-off event, the level of the breath-pressure signal P is reduced to zero by the breath-pressure signal generating portion 66 as shown in FIG. 7A.

Similarly, before the key-off event occurs, the level of the filter coefficient CUTOFF, to be supplied to the low-pass filter 33, is set at the sustain level FSL. Then, after the occurrence of the key-off event, the filter coefficient CUTOFF is increased from the sustain level FSL to the release level FRL in the duration defined by the release rate FRR as shown in FIG. 7C.

After the key-off event, the loop-gain generating portion 60 selectively outputs the reflection coefficients $\gamma_1$, $\gamma_2$ and $\gamma_3$ in turn responsive to the intervals of time defined by the damping release rates DRR1, DRR2 and DRR3. Thus, the selected reflection coefficient is supplied to the multiplier 35 in each interval of time.

Under the operations described above, the envelope waveform of the musical tone signal generated by the musical-tone generating portion 44 is fallen down in level in the release portion as shown in FIG. 7F.

As described before, the number of delay stages 'L' of the delay element 31 in the waveguide W1 is determined in response to the tone pitch, while each of the reflection coefficients $\gamma_1$ to $\gamma_3$ is computed by the foregoing equation (7) based on the number of delay stages 'L'. Thus, the decaying manner of the envelope waveform in the release portion can be set constant, regardless of the tone pitch.

Figure 8:
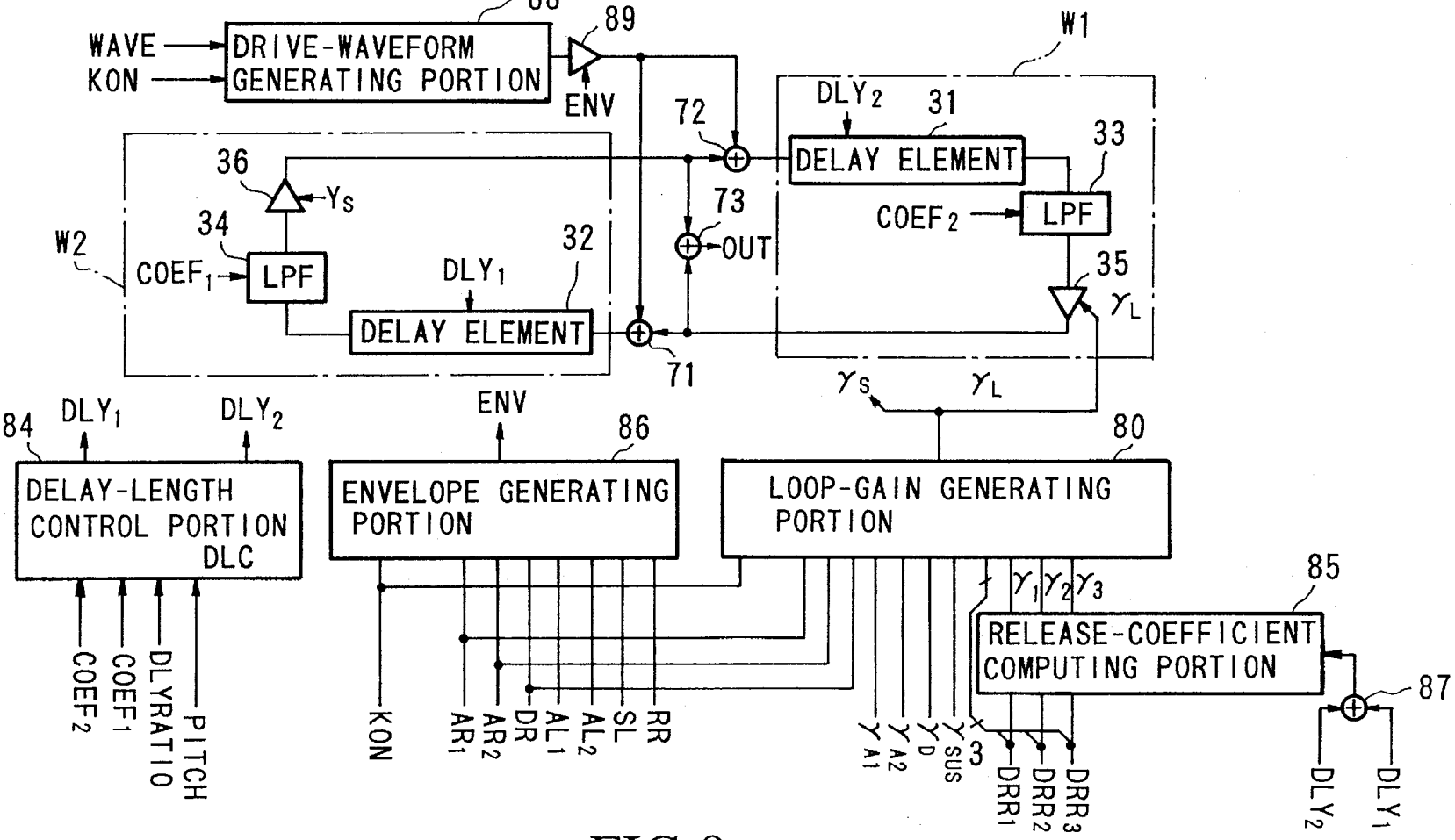
FIG. 8 is a block diagram showing a modified example of the musical-tone generating portion shown in FIG. 5.

Next, a modified example of the first embodiment will be described by referring to FIG. 8. Different from the circuitry shown in FIG. 5, this circuitry shown in FIG. 8 is characterized by that two waveguides W1 and W2, which form a part of the musical-tone generating portion 44, are connected together in parallel by adders 71 and 72. Herein, a signal is formed by multiplying an output signal of a drive-waveform generating portion 88 by an envelope signal ENV whose value is determined in advance; and then, this signal is supplied to the waveguides W1 and W2 through the adders 72 and 71. The drive-waveform generating portion 88 employs the known method, such as the waveform-memory method, by which a desired drive-waveform signal is formed based on a tone-color signal 'WAVE' and the key-on signal KON. In the meantime, an adder 73 adds output signals of the waveguides W1 and W2 together to form a musical tone signal to be outputted from the musical-tone generating portion 44.

As described above, the musical-tone generating portion is characterized by providing the two waveguides W1 and W2. Even in the circuitry shown in FIG. 8, it is necessary to set the decaying manner of the musical tone signal in the release portion constant, regardless of the tone pitch, as similar to the foregoing circuitry shown in FIG. 5. In order to do so, the numbers of delay stages for the delay elements 31 and 32 should be determined under the consideration of the cut-off frequencies of the waveguides W1 and W2 as well as the pitch signal PITCH; and then, the multiplication coefficients to be supplied to the multipliers 35 and 36 should be determined on the basis of the numbers of delay stages.

Thus, a delay-length control portion 84 determines numbers of delay stages 'DLY2' and 'DLY1' for the delay elements 31 and 32 respectively on the basis of the pitch signal PITCH, filter coefficients COEF2, COEF1 and a delay ratio 'DLYRATIO'. Herein, the filer coefficients COEF2 and COEF1 are respectively supplied to the low-pass filters 33 and 34, while the delay ratio 'DLYRATIO' indicates a ratio between the amounts of delay. In the meantime, the circuit portion which generates the filter coefficients COEF1 and COEF2 is similar to the aforementioned filter-coefficient generating portion 67 (see FIG. 5), so that this circuit portion is omitted in FIG. 8. In addition, an envelope generating portion 86, which generates the envelope signal ENV, is similar to the aforementioned breath-pressure-signal generating portion 66 (see FIG. 5). The delay ratio DLYRATIO is calculated by an equation (8).

$$DLYRATIO=DLY1/(DLY1+DLY2) \quad (8)$$

This equation (8) indicates that the delay ratio DLYRATIO is a ratio of the number of delay stages 'DLY1' within the sum of the numbers of delay stages of the delay elements 31 and 32. Incidentally, this delay ratio DLYRATIO can be arbitrarily set by the tone-color setting unit 43.

A total number of delay stages of the delay elements 31 and 32 is calculated by an adder 87; and then, the total number of delay stages calculated is supplied to a release-coefficient computing portion 85.

The release-coefficient computing portion 85 computes coefficients $\gamma_{Li}$, $\gamma_{Si}$ on the basis of the total number of delay stages and the aforementioned damping release rates DRRi (where i=1, 2 or 3). Herein, an equation (9) is used to compute the coefficients $\gamma_{Li}$, $\gamma_{Si}$ in response to the damping release rate DRRi. This equation (9) can be obtained by replacing "dt" in the equation (6) by "DRRi".

$$\gamma_{Li}=\gamma_{Si}=-10^{-(DLY1+DLY2)/(2Fs\cdot DRRi)} \quad (9)$$

In the present example, the multiplication coefficient $\gamma_L$ supplied to the multiplier 35 is set equal to the multiplication coefficient $\gamma_S$ in accordance with the equation (6). However, it is possible to further modify the present example such that those coefficients $\gamma_L$ and $\gamma_S$ are computed under the consideration of the equation (4). In that case, the coefficients computed are different from each other.

Figure 9A:
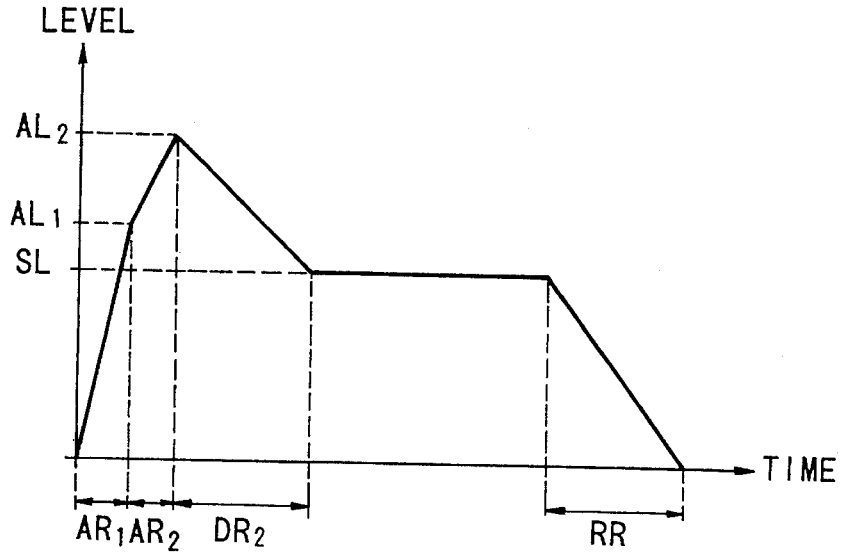
FIGS. 9A to 9C are graphs showing waveforms of signals and a coefficient used in the circuitry shown in FIG. 8.
Figure 9B:
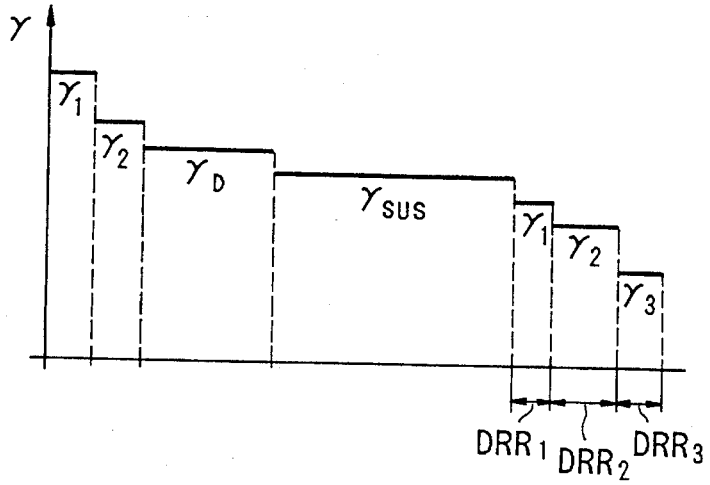
Figure 9C:
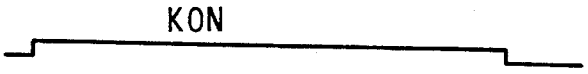

In the present example, the envelope signal ENV is changed as shown in FIG. 9A, while the coefficient 7 is changed as shown in FIG. 9B. As similar to the waveform of the breath-pressure signal P (see FIG. 7A), the waveform of the envelope signal ENV, generated by the envelope generating portion 86, is changed in level as shown in FIG. 9A in accordance with the key-on signal KON (see FIG. 9C). As similar to the level-changing manner of the reflection coefficient $\gamma$ (see FIG. 7B), the reflection coefficients $\gamma_L$ and $\gamma_R$, generated by the loop-gain generating portion, are changed in level as shown in FIG. 9B.

Even in the present example, the total number of delay stages for the delay elements 31 and 32 is determined in response to the tone pitch; and the reflection coefficients $\gamma_1$ to $\gamma_3$ are respectively computed by the equation (9) using the total number of delay stages. Thus, it is possible to set the decaying manner of the envelope waveform in the release portion constant, regardless of the tone pitch.

In the first embodiment and the present example, three reflection coefficients, each having a different value, are used in each of the attack portion and release portion as shown in FIGS. 7B and 9B. However, the number of the reflection coefficients used in each portion can be changed arbitrarily by changing the number of parameters.

[B] Second Embodiment

Before specifically describing the second embodiment, the fundamental principle employed by the second embodiment will be described by referring to FIG. 12.

Figure 12:
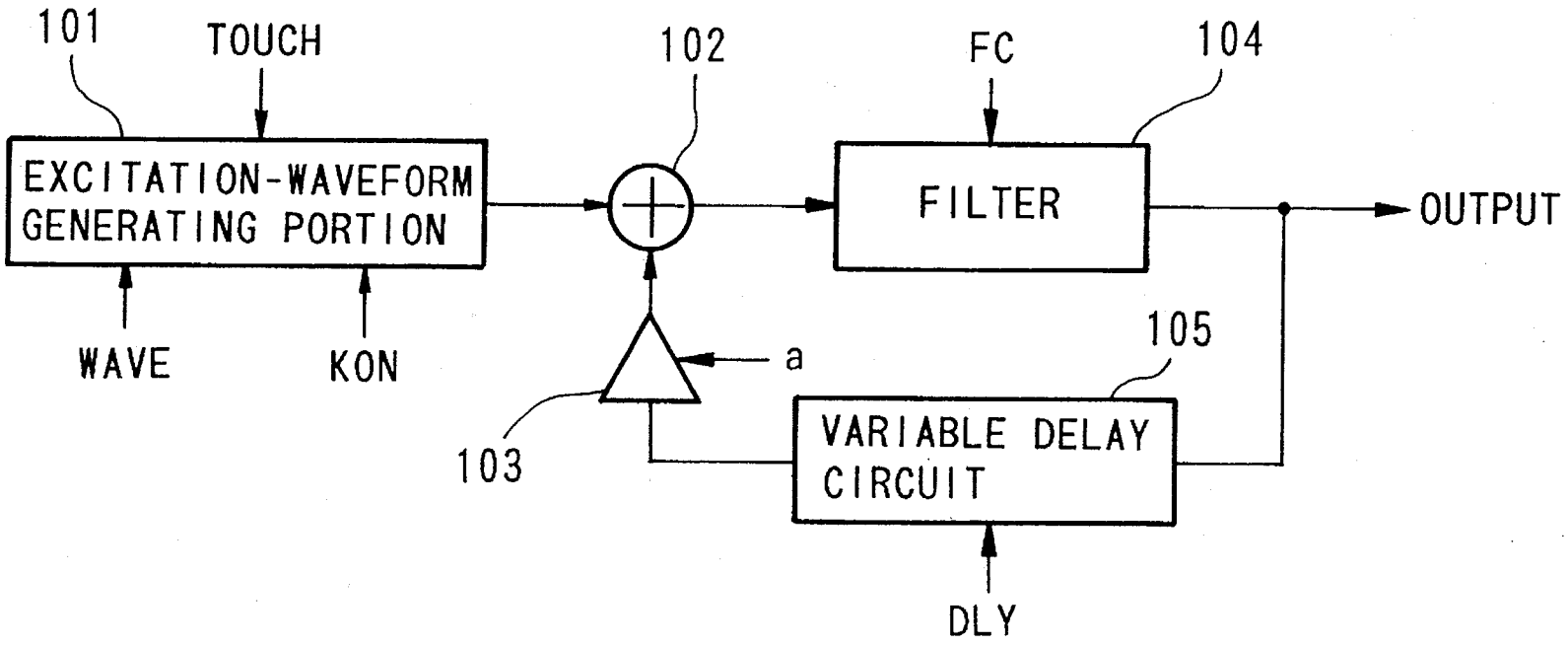
FIG. 12 (PRIOR ART)
FIG. 12 is a block diagram showing an example of the musical tone synthesizing apparatus conventionally known.

Now, a decay rate 'd' (1/sec) is computed in accordance with an equation (10) using a pitch 'p' (Hz) and the gain 'a' of the variable amplifier 103 shown in FIG. 12. Herein, the pitch 'p' is a tone pitch of the fundamental note of the musical tone to be produced, while filter 104 and the like are designed such that the gain 'a' represents the loop gain of the loop circuit shown in FIG. 12.

$$d=a \text{ ^^ } p \ (0<a<1) \quad (10)$$

When expanding the equation (10) with respect to 'a', an equation (11) is obtained.

$$a=d \text{ ^^ } (1/p) \quad (11)$$

In the above equations, a symbol "^^" represents the power, so that an expression "x ^^ y" represents a mathematical expression of "$x^y$", for example.

By performing the key-scaling operation on each musical tone to be produced by use of the above-mentioned 'a', it may be possible to solve the aforementioned problem which the conventional apparatus as shown in FIG. 12 suffers from. In this case, if the precision required is not so high, it is possible to embody the key-scaling device having a simplified processing.

In general, when producing the decaying sound, the gain 'a' used in the equation (10) is less than '1' but is very close to '1'. As described before in conjunction with FIG. 12, the number of the times by which the initial musical-tone waveform repeatedly passes through the feedback loop consisting of the variable amplifier 108 and the variable delay circuit 105 is very large. Therefore, if the gain 'a' is not roughly equal to '1', the sustaining time of the musical tone becomes too short to form a single musical tone which can be acknowledged by the listener. If a relationship of "a=1−b" is introduced, the equation (10) can be rewritten into an equation (12).

$$d=(1-b)\ \hat{}\ p \tag{12}$$

Since the value of 'b' is roughly equal to zero, the equation (12) can be replaced by an approximate expression (13).

$$d=1-p\cdot b \tag{13}$$

When expanding the equation (13) with respect to 'b', an equation (14) can be obtained.

$$b=(1-d)/p \tag{14}$$

By further expanding the equation (14) with respect to 'a', an equation (15) can be obtained.

$$a=1-b=1-(1/p)*(1-d) \tag{15}$$

The above-mentioned equations explain the fundamental principle of the second embodiment. In other words, the second embodiment is designed on the basis of this fundamental principle.

Figure 10:
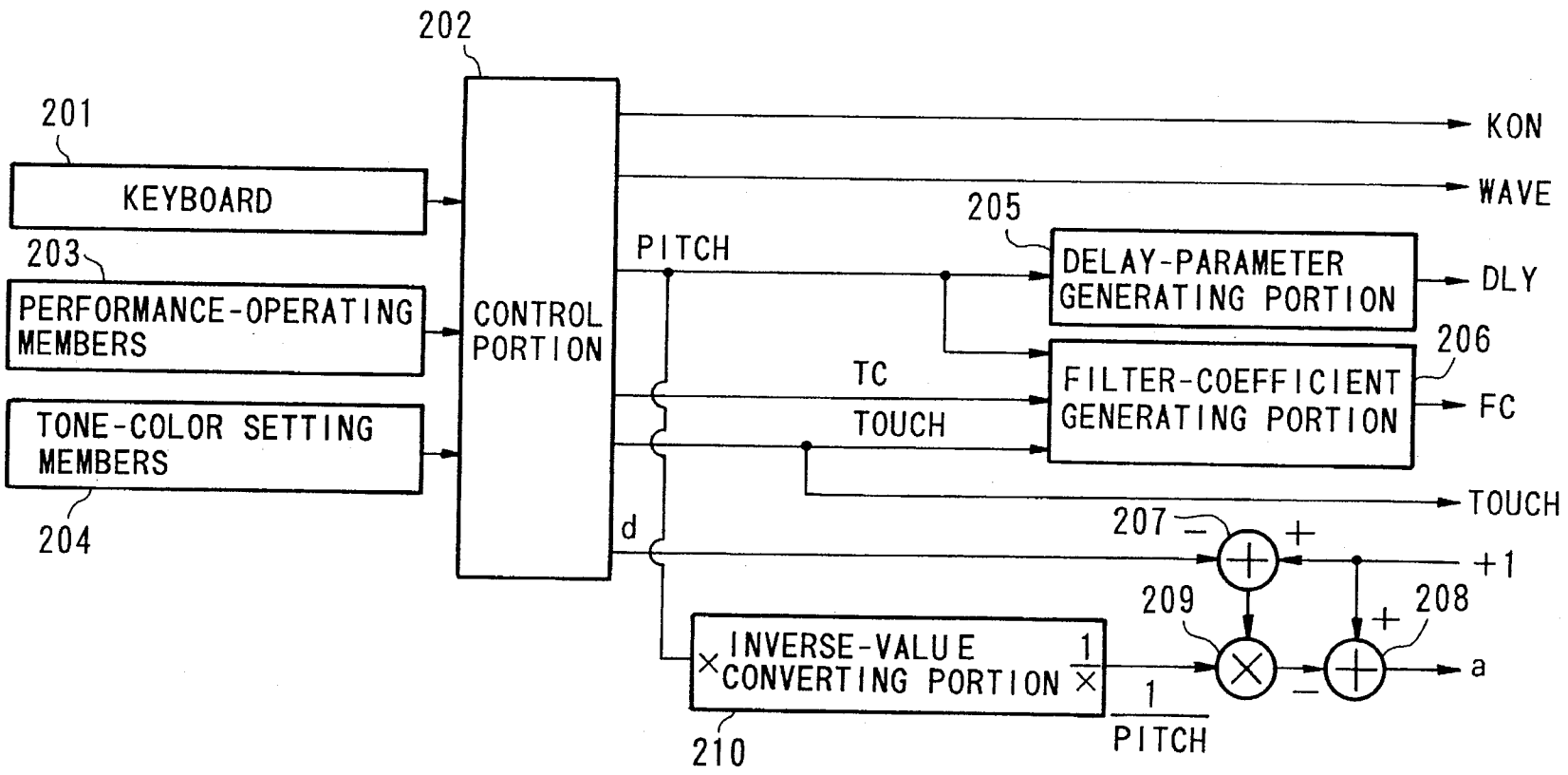
FIG. 10 is a block diagram showing an electronic musical instrument employing a musical tone synthesizing apparatus according to a second embodiment of the present invention.
Figure 11A:
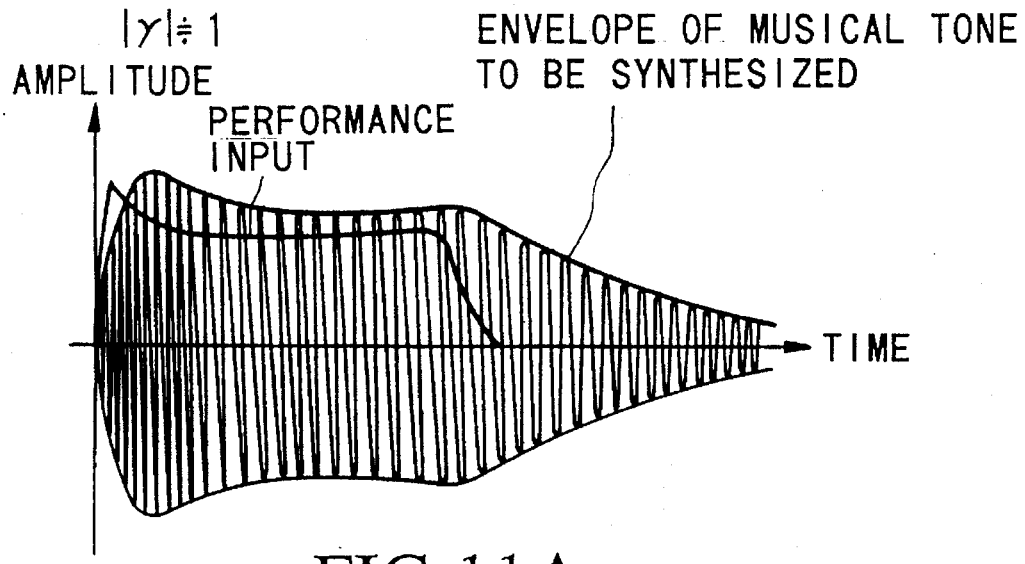
FIGS. 11A and 11B are graphs each showing an envelope waveform of the musical tone, synthesized by the conventional apparatus, in connection with the performance-input data.
Figure 11B:
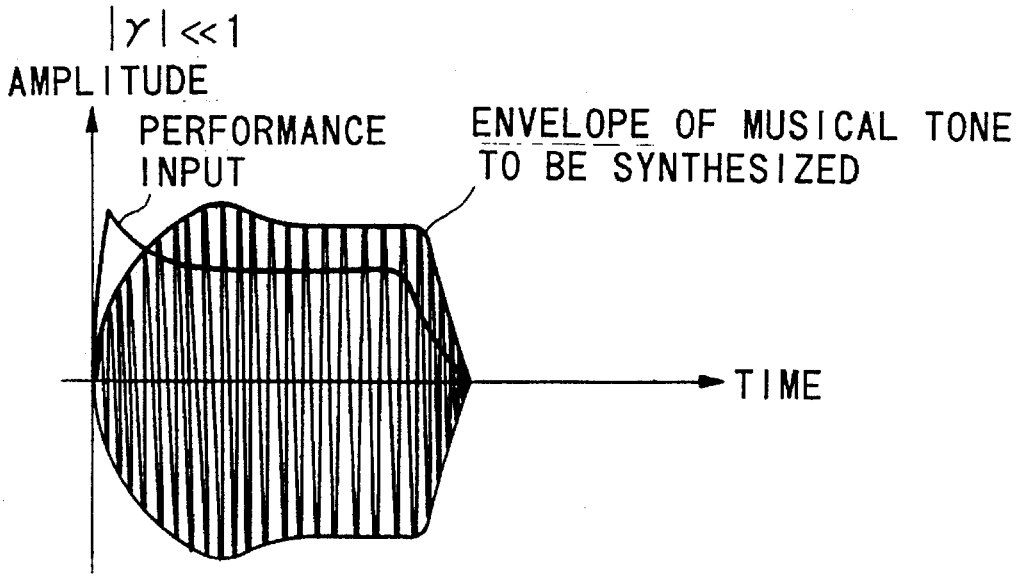

FIG. 10 is a block diagram showing a main part of the electronic musical instrument employing a musical tone synthesizing apparatus, according to the second embodiment, having a key-scaling function.

In FIG. 10, a keyboard 201 scans the keys to detect a key-depressing state. When detecting the key depressed by the performer, the keyboard 201 produces tone-pitch information and information representing the intensity of touching the key as well as a request of tone generation. They are supplied to a control portion 202. The control portion 202 is connected with performance-operating members 203 and tone-color setting members 204. The performance-operating members 203 include a plurality of switches, wherein some switches are provided to set the sustaining time of the musical tone, in other words, the decay rate, while other switches are provided to change the tone pitch. By manipulating the tone-color setting members 204, a desired tone color can be set for the musical tones to be produced. On the basis of several kinds of information supplied from the keyboard 201, the performance-operating members 203 and the tone-color setting members 204, the control portion 202 produces the parameters (i.e., the signals WAVE, TOUCH and KON which are described before in conjunction with FIG. 12) as well as other parameters (i.e., signals PITCH, TC and d). The signal PITCH represents the tone pitch of the musical tone to be produced; and the value thereof corresponds to the pitch 'p' which is described in the aforementioned equation (10). The signal TC represents the tone color, used for the musical tones to be produced, which is determined by the key depression of the performer and the manipulation of the tone-color setting members 204. The signal 'd' is a decay-rate signal representing the decay rate 'd' which is set by the performance-operating members 203.

The signal PITCH is delivered to a delay-parameter generating portion 205 and a filter-coefficient generating portion 206. The delay-parameter generating portion 205 generates and outputs a delay-amount signal, controlling the delay time DLY used by the variable delay circuit 105 shown in FIG. 12. The filter-coefficient generating portion 206 generates and outputs a signal FC, which is used to determine the filter coefficient applied to the filter 104 shown in FIG. 12. This filter-coefficient generating portion 206 also receives the signals TC and TOUCH from the control portion 202. The signal FC, which is generated by the filter-coefficient generating portion 206 on the basis of the three signals PITCH, TC and TOUCH, is used to determine the filter coefficient such that the desired frequency characteristic is imparted to the musical tone.

An adder 207 has a negative input terminal (−) and a positive input terminal (+). The signal d is supplied to the negative input terminal, while a value '1' is supplied to the positive input terminal. This value '1' is also supplied to a positive input terminal of an adder 208. An output signal of the adder 207, which has a value of "1−d" is supplied to a multiplier 209. Meanwhile, the signal PITCH is supplied to an inverse-value converting portion 210. Thus, the value of the signal "PITCH" is converted into an inverse value of "1/PITCH" by the inverse-value converting portion 210. This inverse value is supplied to the multiplier 209. Then, a result of multiplication (representing a value of "(1−d)/PITCH") is supplied to a negative input terminal of the adder 208. The adder 208 produces a gain signal which controls the aforementioned gain 'a' shown in FIG. 12. A result of addition, i.e., the gain signal, has a value of "1−(1−d)/PITCH" which corresponds to the aforementioned equation (6). In other words, the circuit elements 207 to 210 are provided to perform the operation expressed by the mathematical equation (6).

The signals generated by the control portion 202 and the other circuit elements 205 to 210 are supplied to the sound source, shown in FIG. 12, as the parameters. By adequately changing those parameters, it is possible to freely change the sustaining time of the musical tone; in other words, it is possible to improve the performability of the electronic musical instrument. The circuit elements 207 to 210 are provided to compute the gain 'a' from the decay rate 'd'. The provision of those circuit elements contributes to the simplification in the procedure of computation. Further, the second embodiment as shown in FIG. 10 does not use the data table, so that the second embodiment contributes to the reduction of the storage capacity to be required. Thus, it is possible to reduce the cost for manufacturing the electronic musical instrument as a whole.

In the second embodiment described above, the sustaining time of the musical tone is controlled by the decay rate 'd' set by the performance-operating members 203. However, the second embodiment can be modified such that the decay rate is automatically determined in response to the key depression of the performer and the tone color which is set by the tone-color setting members 204. In this modification, a plurality of decay rates are stored in the data table in advance; and then, the desirable one is read from the data table in response to the key depression and the tone color currently set.

The second embodiment is designed based on the approximate expression (6), by which the gain is computed. In contrast, the second embodiment can be re-designed such that the key-scaling operation can be precisely performed by performing the exponential operation as expressed by the equation (11). In this case, the circuit elements 207 to 209 are replaced by a multiplication circuit which is capable of performing the exponential operation using the decay rate 'd' and the inverse value '1/PITCH' outputted from the inverse-value converting portion 210.

Further, the gain 'a' of the multiplier 103 can be corrected by the gain characteristic or the filter coefficient FC of the filter 104. In this case, the gain 'a' is corrected such that the loop gain is retained at a desired value.

The second embodiment is designed to use the hardware elements. However, the second embodiment can be embodied to use the software processing. In this case, the digital signal processor (i.e., DSP) is employed, wherein the microprograms embodying the processing of the second embodiment are executed.

Meanwhile, any kinds of methods can be employed by the excitation-waveform generating portion 101 for the production of the initial waveform. That is, it is possible to employ the waveform-memory-readout method, FM method and the like. Incidentally, the initial waveform is not necessarily related to the musical tone. In other words, it is possible to employ the other waveforms representing the noises or the outputs of the sensors such as the impact sensor.

The second embodiment is designed to control the sustaining time of the musical tone. However, this embodiment can be applied to the effecter using the delay feedback. In this case, the signals produced by the second embodiment can be used to control the coefficients for the effecter which creates the sound effect corresponding to the resonance of tile strings or the resonance of the body of instrument.

Lastly, this invention may be practiced or embodied in still other ways without departing from the spirit or essential character thereof as described heretofore. Therefore, the preferred embodiments described herein are illustrative and not restrictive, the scope of the invention being indicated by the appended claims and all variations which come within the meaning of the claims are intended to be embraced therein.

What is claimed is:

1. A musical tone synthesizing apparatus which synthesizes a musical tone signal by circulating an excitation signal, corresponding to a production of a musical tone, through a loop circuit containing a multiplier and a delay means, comprising:

delay-time control means for controlling a delay time of said delay means in accordance with a tone pitch of a musical tone to be produced; and multiplication-coefficient generating means, which is activated responsive to start and end timings to produce the musical tone, for generating a multiplication coefficient for said multiplier on the basis of the delay time and the tone pitch of the musical tone to be produced.

2. A musical tone synthesizing apparatus which synthesizes a musical tone signal by circulating an excitation signal through a waveguide at least containing a delay circuit and a multiplier, comprising:

delay-time control means for controlling a delay time of said delay circuit in accordance with a tone pitch of a musical tone to be produced;

first coefficient generating means for generating a first coefficient on the basis of the tone pitch, said first coefficient being used by said multiplier in response to an attack portion of an envelope waveform of the musical tone to be produced;

second coefficient generating means for generating a second coefficient on the basis of one of the tone pitch and the delay time, said second coefficient being used by said multiplier in response to a decay portion of the envelope waveform of the musical tone to be produced; and coefficient selecting means for selecting one of said first and second coefficients as a multiplication coefficient of said multiplier in accordance with a state of the envelope waveform of the musical tone to be produced.

3. A musical tone synthesizing apparatus according to claim 2 further comprising:

filter-coefficient generating means for generating a filter coefficient for a filter, contained in said waveguide, in response to a tone color of the musical tone to be produced.

4. A musical tone synthesizing apparatus comprising:

excitation-waveform generating means for generating an excitation waveform;

variable delay means for delaying said excitation waveform by a desired amount of delay;

variable amplifier means for attenuating an output waveform of said variable delay means by a desired amount of attenuation;

adder means for adding an output of said variable amplifier means to said excitation waveform, wherein said variable delay means, said variable amplifier means and said adder means are configured together to form a feedback loop;

first setting means for setting the desired amount of delay;

second setting means for setting an attenuation characteristic for a musical tone signal to be outputted from said variable delay means; and third setting means for setting the desired amount of attenuation in response to the desired amount of delay and the attenuation characteristic.

5. A musical tone synthesizing apparatus which synthesizes a musical tone signal by circulating an excitation signal through a loop circuit containing an adder, a filter, a delay circuit and a multiplier, comprising:

delay-time determining means for determining a delay time for the delay circuit in accordance with a tone pitch of a musical tone to be produced;

filter-coefficient determining means for determining a filter coefficient for the filter in accordance with a tone color of the musical tone to be produced; and loop-gain computing means for computing a loop gain on the basis of a decay rate and the tone pitch of the musical tone to be produced, said loop gain being used as a multiplication coefficient of the multiplier.

6. A musical tone synthesizing apparatus according to claim 5 wherein said loop-gain computing means computes the loop gain 'a', on the basis of the decay rate 'd' and the tone pitch 'p', in accordance with a following equation:

$$a=1-(1-d)/p.$$

* * * * *